US010083683B2

(12) United States Patent
Huo et al.

(10) Patent No.: US 10,083,683 B2
(45) Date of Patent: Sep. 25, 2018

(54) REDUCING COMPUTER FAN NOISE

(71) Applicant: International Business Machines Corporation, Armonk, NY (US)

(72) Inventors: Zhan Peng Huo, Beijing (CN); Yang Liang, Beijing (CN); Shu Jun Tang, Beijing (CN); Ying Zhao Yan, Beijing (CN); Ting Yin, Beijing (CN); Hui Hui Zhao, Shanghai (CN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/289,289

(22) Filed: Oct. 10, 2016

(65) Prior Publication Data

US 2018/0102124 A1 Apr. 12, 2018

(51) Int. Cl.
*G10K 11/16* (2006.01)
*G10K 11/178* (2006.01)

(52) U.S. Cl.
CPC ..... *G10K 11/178* (2013.01); *G10K 11/1788* (2013.01); *G10K 2210/11* (2013.01);
(Continued)

(58) Field of Classification Search
CPC ..... G10K 2210/11; G10K 2210/30231; G10K 2210/3025; G10K 2210/3044;
(Continued)

(56) References Cited

U.S. PATENT DOCUMENTS 5,621,656 A * 4/1997 Langley ..... G10K 11/178 700/280
7,693,292 B1 4/2010 Gross et al.
(Continued)

FOREIGN PATENT DOCUMENTS

CN 102954045 B 2/2016
GB 2378081 A * 1/2003 ..... G10K 11/1788
GB 2378081 A * 1/2003 ..... G10K 11/1788

OTHER PUBLICATIONS

Gether, H., "Active noise cancellation: Trends, concepts, and technical challenges", EDN, Oct. 8, 2013. http://www.edn.com/design/consumer/4422370/Active-noise-cancellation-Trends-concepts-and-technical-challenges Last accessed Sep. 7, 2016, 5 pages.
(Continued)

*Primary Examiner* — William A Jerez Lora
(74) *Attorney, Agent, or Firm* — Scott S. Dobson

(57) ABSTRACT

A noise source emits an acoustic noise wave with a noise frequency corresponding to an attribute of a control-status signal associated with the noise source. A method to reduce the noise comprises generating, based on the noise frequency corresponding to the attribute, an anti-noise signal having the noise frequency. The method further comprises phase-shifting the anti-noise signal to output a phase-shifted anti-noise signal that can be used to generate a noise-cancelling acoustic wave. The method can include aligning the first anti-noise signal to be in-phase with the acoustic noise wave. An anti-noise apparatus to implement the method includes an anti-noise generator, to generate the anti-noise signal, and a phase shifter to generate and output the phase-shifted anti-noise signal. The anti-noise apparatus can include a phase detector and phase alignment element to align the anti-noise signal to be in-phase with the acoustic noise wave.

15 Claims, 3 Drawing Sheets

(52) U.S. Cl.
CPC ..... *G10K 2210/3025* (2013.01); *G10K 2210/3044* (2013.01); *G10K 2210/30231* (2013.01)

(58) Field of Classification Search
CPC ... G10K 2210/3032; G10K 2210/3045; G10K 2210/51; G10K 2210/511; G10K 2210/512; G10K 11/1784; G10K 11/1788
USPC ..... 381/56, 58, 71, 71.3, 71.4, 71.5, 71.6, 381/71.7, 71.8, 71.13, 71.14
See application file for complete search history.

(56) References Cited

U.S. PATENT DOCUMENTS

| | | | | |
|---|---|---|---|---|
| 7,869,607 | B2 | 1/2011 | Barath et al. | |
| 8,331,577 | B2 | 12/2012 | Lyon et al. | |
| 8,855,329 | B2 | 10/2014 | Slapak et al. | |
| 2006/0142901 | A1* | 6/2006 | Frankel | H05K 7/20209 700/300 |
| 2011/0075854 | A1* | 3/2011 | Sakamoto | G10K 11/1788 381/71.1 |
| 2013/0022212 | A1* | 1/2013 | Hopkins | F04D 29/663 381/71.3 |
| 2013/0136270 | A1* | 5/2013 | Sakamoto | G10K 11/16 381/71.4 |

OTHER PUBLICATIONS

Heidmann, et al., "Flight-Effects on Predicted Fan Fly-By Noise", NASA Technical Reports Server (NTRS), Jan. 1, 1977. http://ntrs.nasa.gov/search.jsp?R=19780005117 Last accessed Sep. 7, 2016, 1 page.

Kraft, et al., "Active Control of Fan Noise: Feasibility Study. vol. 4; Flyover System Noise Studies", Nasa Technical Reports Server (NTRS), Sep. 1, 1996. http://ntrs.nasa.gov/search.jsp?R=19970001736 Last accessed Sep. 7, 2016, 2 pages.

Sharma, et al., "Server noise: Health Hazard and it's reduction using active noise control", Proceedings of 2014 RAECS UIET Panjab University Chandigarh, Mar. 6-8, 2014. 6 pages.

Unknown, "Fan Noise Prediction", Penn State University, Jul. 12, 2000. https://www.google.com.hk/url?sa=t&rct=j&q=&esrc=s&source=web&cd=5&ved=0ahUKEwj0nYTY7-rNAhXlrD4KHfReDhgQFghCMAQ&url=http%3A%2F%2Fwww.mne.psu.edu%2Flamancusa%2Fme458%2F11_fan.df&usg=AFQjCNFkoMie3zh2yknXtrh9LdGXN1Qqtg&cad=rja 5 pages.

Unknown, "Active Noise Cancellation For Small Rooms Demonstration", Youtube, Sep. 22, 2014. https://www.youtube.com/watch?v=UyN1TACCbHE Last accessed Sep. 7, 2016, 4 pages.

* cited by examiner

REDUCING COMPUTER FAN NOISE

BACKGROUND

The present disclosure relates to acoustic noise in a system, and more specifically, to reducing acoustic noise in a system.

SUMMARY

According to embodiments of the present disclosure, a noise source emits an acoustic noise wave having a particular noise frequency. The noise frequency corresponds to an attribute of a control-status signal associated with the noise source. A method to reduce the noise comprises receiving the control-status signal and, based on the correspondence of the noise frequency to the attribute, generating an anti-noise signal with the noise frequency. The method further comprises shifting the phase of the anti-noise signal and outputting the phase-shifted anti-noise signal for use to generate a noise-cancelling acoustic wave out of phase with the acoustic noise wave.

The method can further comprise detecting a phase of the noise wave and generating a phase reference signal having the noise frequency in-phase with the acoustic noise wave. The method then uses the phase reference signal and anti-noise signal to generate a phase difference signal. The method further uses the phase difference signal to generate a phase alignment signal used, in turn, to generate the anti-noise wave in-phase with the acoustic noise wave.

An anti-noise apparatus that can embody aspects of the method includes an anti-noise signal generator and a phase shifter. The anti-noise signal generator receives the control-status signal and, based on the correspondence of the noise frequency to the attribute, generates and outputs the anti-noise signal with the noise frequency. The phase shifter receives the anti-noise signal and generates a second anti-noise signal shifted in phase relative to a phase of the first anti-noise signal. The phase shifter outputs the phase-shifted anti-noise signal such that it can be used to generate a noise-cancelling acoustic wave out of phase with the acoustic noise wave.

Embodiments of an anti-noise apparatus can include a sensor, a phase detector, and a phase alignment element. The sensor detects the acoustic noise wave and outputs a phase reference signal in-phase with the acoustic noise wave. The phase detector receives the phase reference signal and the anti-noise signal output from the anti-noise signal generator and outputs a phase difference signal corresponding to a phase difference between the phase reference signal and the anti-noise signal. The phase alignment element receives the phase difference signal and, based on the phase difference signal, generates and outputs a phase alignment signal, used by the noise generator, to output the first anti-noise signal in-phase with the acoustic noise wave.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
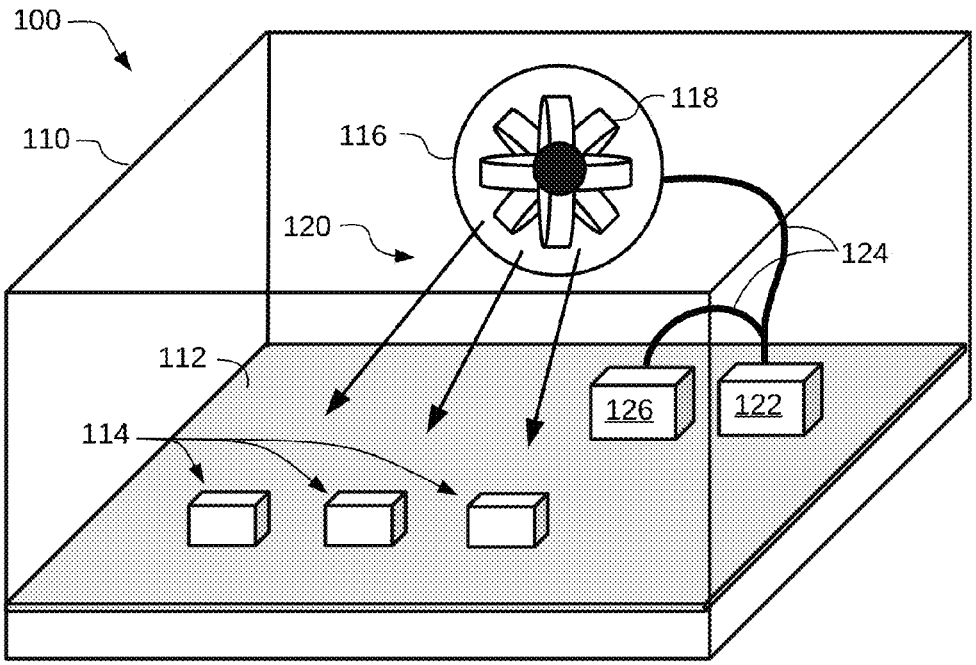
FIG. 1 is a block diagram illustrating an example computer, according to aspects of the disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure (hereinafter, "the disclosure") relate to noise in systems, more particular aspects relate to reducing noise in a system. "Wave" is used herein to refer to waves (e.g., sound waves) associated with, or producing, acoustic noise. "Noise" (or, "acoustic noise"), as used herein, refers to acoustic noise (e.g., audible sound) that is undesirably present in a system.

As used herein, the term "system" refers to systems in which acoustic noise can be present in the system. Examples of such systems, within the scope of the disclosure, include, but are not limited to, computers and/or computing systems, or components of a computer or computing system such as a network gateway or router, a storage system or subsystem, a power supply, or an electronic chassis or enclosure of a computer or computing system. In some embodiments, a system can also include electrical generation and/or power transformation systems, and other systems, or components thereof, that include sources of acoustic noise (e.g. fans, or electrical transformers). While the present disclosure is not necessarily limited to such applications, various aspects of the disclosure can be appreciated through a discussion of various examples using this context.

Systems can include components, and/or devices, that emit acoustic noise. For example, cooling fans in a computer or computing system can emit acoustic noise associated with a fan motor, fan blades, and/or airflow produced by the fan. In another example, an electrical power system can include voltage transformers that can emit acoustic noise associated with alternating current and/or voltage in the transformer. Such acoustic noise can be undesirable if, for example, it exceeds legal or regulatory levels (e.g., as measured in decibels) or reduces the commercial competitiveness of a system in comparison to similar systems that emit less acoustic noise. Accordingly, reducing or eliminating acoustic noise in embodiments of the disclosure (hereinafter, "embodiments") can improve a system design.

Waves comprise oscillatory phases varying from 0 to 360 degrees within each oscillatory cycle. Combining two waves that have the same oscillatory frequency, but that are out of phase with each other, can reduce the amplitude (or, power level) of the waves. That is, the waves combine "destructively" to reduce their respective amplitudes. Combining two waves of the same frequency that are out of phase by 180 degrees can produce the maximum destructive reduction in amplitude of the waves. If two waves of the same frequency have equal amplitude and are 180 degrees out of phase, combining the two waves can reduce the amplitude of the waves to zero.

Conventional "Active Noise-Cancelling (ANC)" circuits, or noise reduction systems, can reduce acoustic noise in some systems, such as in noise-cancelling ear phones. Conventional ANC circuits, and other noise-reduction systems, can require complex circuitry and/or processors to collect and analyze the various noise frequencies, to determine at which frequencies to apply noise-cancelling waves. Noise collection and analysis can also be difficult and require long processing times in some conventional systems, particularly systems in which the spatial distribution of the noise can be large, such as, for example, a computer chassis or other electronic or electrical enclosure or system.

For example, a conventional ANC circuit for an earphone can limit collecting and analyzing noise to a small spatial region in the vicinity of the human ear. Further, conventional noise reduction systems may concentrate noise-canceling waves in only a small spatial region as well, such as the opening of a human ear. In comparison, noise sources in some systems can emit noise in large spatial regions—such as within a computer chassis—which can be difficult environments in which to collect noise frequencies, to analyze corresponding power levels at different points within that space, and/or to generate and direct noise-cancelling waves. Consequently, conventional noise-reduction systems, such as conventional ANC systems, can be difficult, costly, and/or impractical to implement.

However, noise sources can emit noise in which at least a portion of the noise power levels (e.g., sound power, or volume) are known to concentrate at particular frequencies, or in particular frequency ranges, and in which those frequencies can correspond to, or are associated with, particular operational characteristics or attributes of the noise source. Accordingly, some embodiments can utilize these characteristics and/or design an anti-noise apparatus that does not require circuits and/or processors to collect and analyze noise frequencies, and/or spatial locus of those frequencies, and can thereby incorporate a simpler anti-noise apparatus.

FIG. 1 illustrates an example of a system 100 having a noise source and an enhanced noise cancelling circuit according to embodiments of the disclosure. In the example of FIG. 1, the system 100 is implemented as a computer in which a cooling fan is a noise source within the system. It is to be understood that system 100 is a simplified example of a computer, for purposes of explanation, and that other components can be included in implementations of system 100. Computer 100 comprises chassis 110 (i.e., a mechanical enclosure, such as made of sheet metal or plastic), system backplane 112 enclosed within chassis 110, electronic components 114 mounted on backplane 112, cooling fan 116, fan controls 122, and enhanced noise cancelling circuit 126.

As understood by one of skill in the art, backplane 112 communicatively couples one or more components mounted on the backplane 112, such as electronic components 114, enhanced noise cancelling circuit 126, and fan controls 122. Components 114 can include various electronic components, such as power circuits and/or power supplies, processors, memories, Input/Output (IO) bridges, devices, and/or adapters, and so forth. While operating, components 114 can generate varying amounts of heat and cooling fan 116 can provide airflow within (and/or exiting) chassis 110 to cool the components. For example, as shown in FIG. 1, cooling fan 116 generates airflow within chassis 110 in the direction indicated as 120 to flow over components 114 to provide cooling airflow.

Components 114 can vary in operation, such as to provide more or less electrical power to electrical or electronic components of computer 100, and/or to increase or decrease the number and/or rate (e.g., operations per second) of computations, memory accesses, and/or data transfer operations, for example, the component perform. Components 114 can generate more or less heat as they vary in operations (e.g., increase or decrease the rate of operations) and, correspondingly, computer 100 can require fan 116 to increase or decrease the speed (e.g., rotations per minute, or "RPMs") of fan blades 118 (hereinafter "fan speed") to increase or decrease the amount of airflow directed towards components 114.

A computer (or, other embodiments that include, for example, a fan) can include circuitry or components to control the fan speed (hereinafter "fan controls"). Also, in embodiments, fan controls can receive signals associated with variations in component operations to thereby control the fan speed based on the cooling demands of the components. Alternatively, in embodiments, fan controls can include or receive outputs of, for example, thermal sensors that detect air or component temperatures associated with the operations of components cooled by a fan. Accordingly, fan controls can vary fan speed as thermal conditions of components, or (for example) air in the region of the components within a system, varies.

Using the example of FIG. 1, fan controls 122 are connected by one or more wires 124 to fan 116 and can convey signals over wire(s) 124 to control (increase or decrease) the fan speed of fan 116. Fan controls 122 can receive signals from components 114, for example, that can indicate operating states of one or more components (e.g., clock frequencies, processor workload, or other measures of activity of a processor component). As operating states of components 114 vary, fan controls 122 can convey a control signal, on wire(s) 124, to fan 116 to signal the fan increase or decrease speed. As the voltage (e.g., the amplitude of the voltage) of the control signal increases or decreases, for example, the fan can correspondingly increase or decrease fan speed. As used herein, "voltage" refers interchangeably to direct current (DC) and alternating current (AC) voltages, according to particular embodiments. Similarly, "current" refers interchangeably to DC and AC current signals, according to particular embodiments.

As previously described, fans, such as 116, can emit acoustic noise associated with, for example, fan motors, movement of fan blades through air, and/or airflow produced by the fan. As fan speed increases, acoustic noise—particularly, audible acoustic noise—can increase correspondingly. Reducing, or "canceling", acoustic noise in computer 100 can improve acoustic characteristics of the computer to, for example, maintain an acoustic noise level below regulatory or standards based levels (e.g., particular decibel ratings), or to improve commercial competitiveness of the computer in comparison to other, similar computers.

Figure 2:
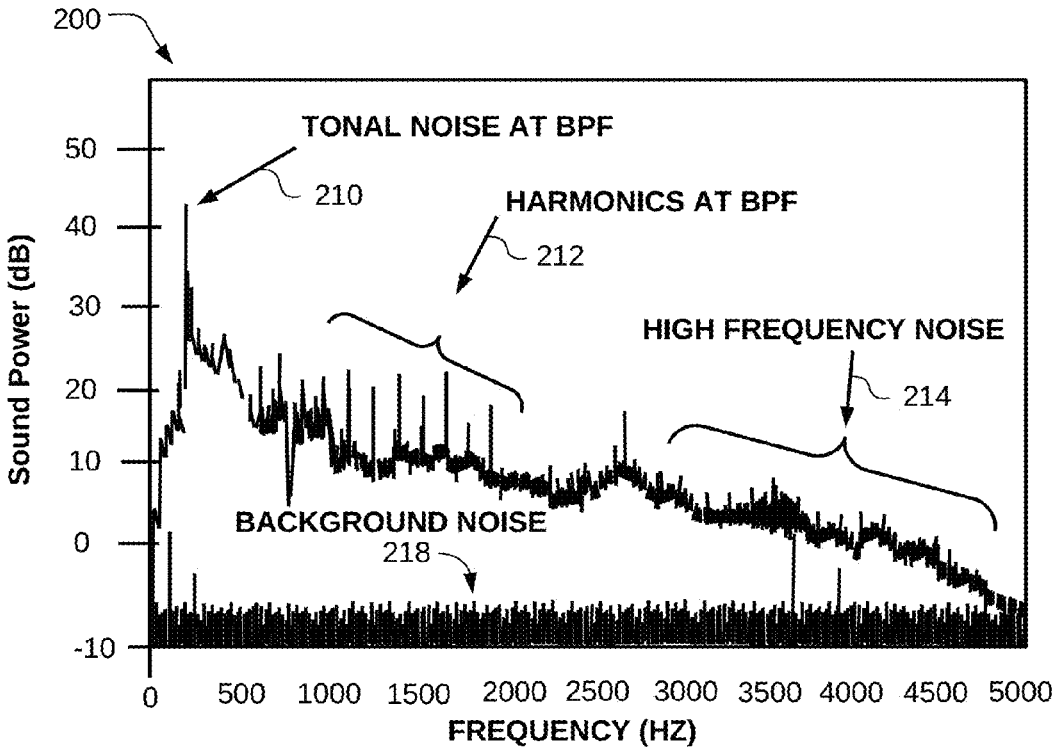
FIG. 2 is an example frequency spectrum associated with a noise source, according to aspects of the disclosure.

FIG. 2 illustrates an example graph of acoustic noise volume (sound power) versus acoustic noise frequency associated with an example embodiment having a fan, such as fan 116 in computer 100 of FIG. 1. For example, FIG. 2 can illustrate the frequency spectrum of a fan having, for example, a particular number of blades and measured at a particular distance from the fan blades within a particular computer chassis structure.

The vertical axis of FIG. 2 represents sound power (e.g., sound "volume" in audible frequency ranges), measured in decibels (dB), over a frequency range measured in Hertz (Hz). As can be seen in FIG. 2, sound power can be higher at frequencies associated with "tonal noise" associated with fan speed. As illustrated in FIG. 2, tonal noise can have higher or maximum sound power at a frequency corresponding to the "Blade Passing Frequency (BPF)" associated with the speed of fan blades (e.g., rotational or linear speed of the blades).

Other frequency components of fan noise illustrated in FIG. 2 include background noise 218, harmonic frequencies 212 of the BPF, and high frequency broad band noise 214. As can be seen from FIG. 2, tonal noise at the BPF can be substantially (e.g., 10 or more dB) higher than other frequency components of fan noise. In embodiments, the frequency of a noise wave can further relate to signals, such as control and/or status signals, controlling or associated with the noise source. For example, as illustrated in the example computer of FIG. 1, a computer can include fan controls to control fan speed. As fan speed increases or decreases, BPF of the fan increase or decrease corresponding, BPF (at which tonal noise occurs) of a fan can correspond, then, to an attribute, such as voltage, of a fan speed control signal.

Alternatively, a noise source (or a system component associated with a noise source) can output a status signal that has a known relationship to a dominant noise frequency (a frequency, or frequencies, at which noise power is concentrated, as compared to other frequencies). For example, fan 116 in FIG. 1 can output a status signal (not shown in FIG. 1) that corresponds, for example, to the rotational speed of the fan blades, which in turn can correspond to the BPF at which the fan is operating at a particular moment. In an alternative embodiment, a status signal can have an attribute (e.g., a voltage level) that corresponds to, or represents, a frequency at which a noise source (e.g., a circuit) is operating.

As used herein, "control-status" signal refers to any type of control or status signal associated with a noise-source and that has a defined, or known, relationship (e.g., based on an attribute of the signal such as a voltage, current, or frequency) to a frequency of noise emitted by a noise source. In embodiments, the relationship between a control-status signal (e.g., or, attributes thereof), and a noise frequency (e.g., BPF of a fan) emitted by a noise source controlled by the signal, can be determined, as a design characteristic, by testing or measuring the system.

For example, a fan speed control and BPF at which the fan is operating can have a linear relationship to a voltage level of a control signal such as:

$$BPF=(kv*t)/60$$

where BPF is in Hz, "t" is a number of fan blades, and "kv" is the rotational velocity (in RPMs) of the fan blades expressed as a rotational velocity coefficient, "k", times the voltage, "v", of the control signal. A voltage value of a fan speed control (e.g., in fan controls 122) can correlate to "kv" in the foregoing example formula to determine BPF of a fan (e.g., fan 116). In an alternative embodiment, a fan can output a signal (e.g., in fan controls 122) representing fan RPMs, in which a voltage value of the output signal can correlate to "kv" in the foregoing example formula to determine BPF of a fan (e.g., fan 116).

While the example of FIG. 2 illustrates an embodiment in which fan noise is related to fan speed, or BPF, other embodiments can have particular, known frequencies at which noise power (or, a portion thereof) is concentrated, and the known frequencies can correspond to operational characteristics of the noise source. For example, an electrical transformer can emit acoustic noise and the signal noise can be correlate to, for example, an input and/or output voltage level of the transformer. It would be apparent to one of ordinary skill in the art that frequencies and, particularly, the dominant noise power frequencies, of a noise source in a system can be determined (e.g., analytically, or by testing or measuring) to correlate to particular inputs to and/or outputs from a noise source.

Also, in embodiments, amplitude of a noise wave at particular frequencies can be associated with the particular design of a noise source. The amplitudes of the noise at those frequencies can be determined, as a design characteristic, by testing or measuring the system. An anti-noise apparatus can generate an amplitude of noise-cancelling waves based on the known relationship of the amplitudes of the noise waves at those frequencies.

Accordingly, an embodiment can include an anti-noise apparatus, which can produce an anti-noise signal based on a predicted or measured relationship between a control-status signal, associated with a noise source, and a noise frequency (or, frequencies) emitted by the noise source. An embodiment can utilize an anti-noise signal to generate noise-cancelling waves to combine with a noise wave to reduce the amplitude of the noise, such as below an acceptable (e.g., regulatory, or circuit design) power (or, sound) level.

Figure 3:
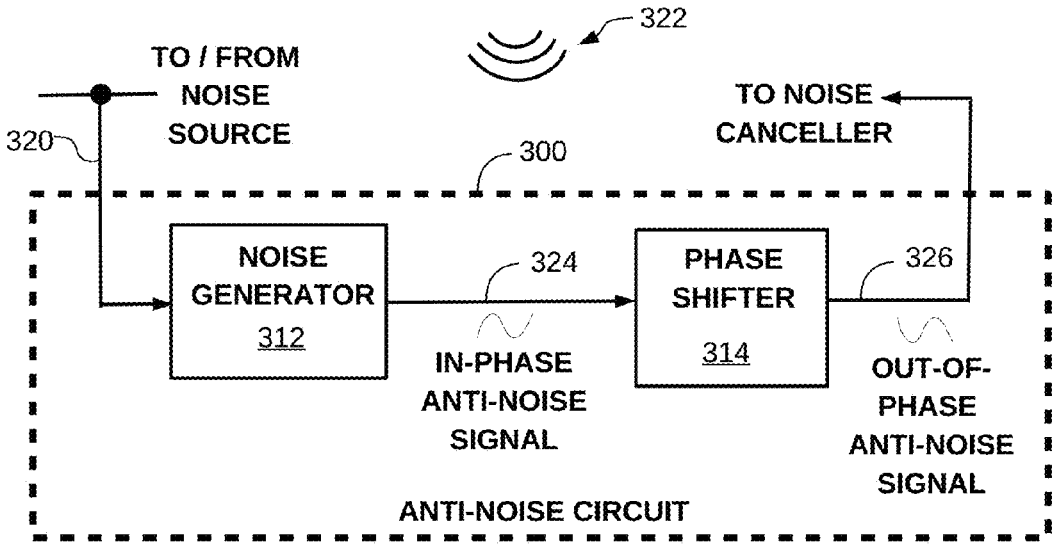
FIG. 3 is block diagram illustrating an example anti-noise apparatus, according to aspects of the disclosure.
Figure 4:
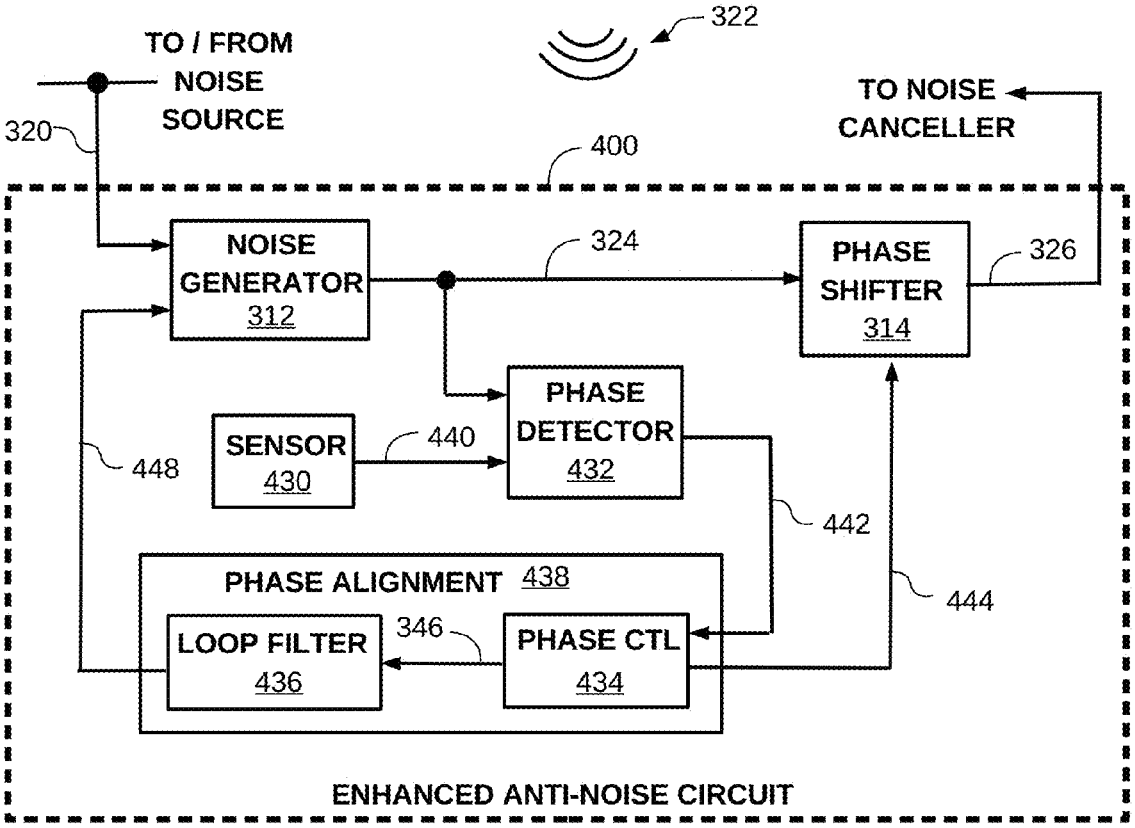
FIG. 4 is block diagram illustrating an example alternative anti-noise apparatus, according to aspects of the disclosure.

FIG. 3 and FIG. 4 illustrate example anti-noise circuits, in the context of example computer 100 of FIG. 1 and fan acoustic noise therein. The anti-noise circuit, 126, illustrated in FIG. 1, can be implemented, for example, using one of the example anti-noise circuits illustrated in FIGS. 3 and 4. The examples of FIGS. 3 and 4 are useful to illustrate the disclosure, but are not intended to limit embodiments. It would be apparent to one of ordinary skill in that art that the principles illustrated in FIGS. 3 and 4 can be employed in a variety of embodiments, within the scope of the disclosure.

In FIG. 3, anti-noise circuit 300 includes noise generator 312. Noise generator 312 receives a control-status signal, 320, that has a known (e.g., predicted or measured) relationship to a frequency of a noise wave, illustrated as noise wave 322, emitted by a noise source in a system. In the context of the example of FIG. 3, control-status signal 320 can be, for example, a fan speed control communicated from fan controls 122 by wire(s) 124 to fan 116 of FIG. 1. In an alternative example, control-status signal 320 can be an output signal communicated on wire(s) 124 from fan 116, representing, or corresponding to, fan RPMs. Control-status 320, correspondingly, can have a voltage proportional to the fan speed (e.g., in which a higher voltage level corresponds to a faster fan speed).

Noise generator 312 generates (and outputs) "in-phase" anti-noise signal 324. Noise generator 312 can generate anti-noise signal 324 at a frequency corresponding to an attribute, or characteristic, of control-status signal 320. The frequency can be associated with a particular power level (e.g., sound volume) of a noise relative to the power level of other frequency components of the noise (or, frequency components of multiple sources of noise in a system). For example, noise generator 312 can generate signal 324 to have a frequency corresponding to a BPF of a fan, based on the BPF having a known relationship (for example) to a voltage level (an attribute or characteristic) of control-status signal 320, and the BPF corresponding to a frequency of tonal noise of the fan having known to have a higher sound volume, compared to other frequency components of the fan (or other system) noise.

To generate a signal having a frequency corresponding to a noise wave and, for example, based on a control-status signal, a noise generator can include a voltage-controlled oscillator, or "VCO". A VCO is a device that can receive an input voltage (e.g., an AC or DC voltage) and generate a cyclic output signal having a frequency corresponding to the input voltage. The VCO can be designed to transform a particular voltage range to a particular frequency range.

Using the example of FIG. 3, noise generator 312 can include a VCO designed to translate voltages of control-status signal 320 to particular frequencies of noise wave 322. In the context of the example of FIG. 1, noise source 310 can be a fan, such as fan 116, and noise generator 312 can receive a fan speed control-status signal (e.g., coupled to wire(s) 124) as an input to a VCO. The VCO can, in turn, generate anti-noise signal 324 to have a frequency corresponding to the BPF of the fan at a particular speed corresponding to the voltage of speed control-status signal.

Noise generator 312 can generate anti-noise signal 324 in-phase (or, partly in-phase) with noise wave 322. Noise generator 312 outputs anti-noise signal 324 as an input to phase shifter 314. Phase shifter 314 delays the phase of anti-noise signal 324 by 180 degrees to generate anti-noise signal 326 to be "out of phase" with noise wave 322 by an amount corresponding to the amount that anti-noise signal 324 is in-phase with noise wave 322. As previously described, combining two waves that are out of phase can combine destructively to reduce the amplitude of the waves. Accordingly, anti-noise signal 326 can be output from phase-shifter 314 to a noise-canceller, which in turn can generate an acoustic anti-noise wave, based on the frequency and phase of anti-noise signal 326, that can be then destructively combined with noise wave 322 to reduce the amplitude of noise wave 322, based on the amount that the anti-noise wave is out of phase with noise wave 322.

In the example of FIG. 3, noise generator 312 generates anti-noise signal 324 based on a control-status signal associated with a noise source. Accordingly, noise generator 312 can generate anti-noise signal 324 to have a frequency corresponding to a frequency (e.g., tonal noise BPF of a fan) of noise wave 322. However, the phase correlation between noise wave 322 and anti-noise signal 324 can be imprecise without any particular phase reference to noise wave 322. As previously described, destructive combination of two waves (or, signals) of the same frequency varies according to the phase relationship of the two waves (that is, varies with the degree the waves are out of phase) and is maximized when the two waves are 180 degrees out of phase.

FIG. 4 illustrates another example anti-noise circuit 400. The example noise circuit 400 is similar to the anti-noise circuit 300 but includes an enhanced anti-noise circuit. In FIG. 4, elements of anti-noise circuit 400 that are common to anti-noise circuit 300 are indicated using the same reference numbers as used in FIG. 3.

Enhanced anti-noise circuit includes phase-lock components, not included in anti-noise circuit 300, that can align anti-noise signal 324 to be more in-phase with noise wave 322 than without the phase-lock components, such that anti-noise signal 326, output from phase shifter 314, is more fully (e.g. closer to being precisely 180 degrees) out of phase with noise wave 322. Generating anti-noise signal 326 more fully out of phase with noise wave 322 can in turn enable using anti-noise signal 326 to generate an anti-noise wave that combines destructively with noise wave 322 for increased amplitude reduction. The addition of phase lock components, such as illustrated in FIG. 4, to an anti-noise circuit, such as 300 in FIG. 3, can thereby improve the noise-cancelling properties of the anti-noise circuit and/or a noise-canceller.

As shown in FIG. 4, phase-lock components can include sensor 430, phase detector 432, and phase alignment element 438. A sensor can operate to detect the frequency and phase of an input wave (or, a cyclic signal) and can output a phase reference signal, at that frequency, in-phase with the input wave (or, signal). A phase detector can receive two input signals and detect differences in the signal phases at particular frequencies. The phase detector can then output a phase difference signal (e.g., a voltage level) corresponding to the difference in phase between the two input signals at one or more frequencies. A phase alignment element can transform the phase difference signal into a phase alignment signal which, in turn, can be used by a noise generator to align the phase of an anti-noise signal, at a particular noise frequency, to a phase of a noise wave at that noise frequency.

As illustrated in FIG. 4, sensor 430 can receive noise wave 322 and generate phase reference signal 440 at a particular frequency of noise wave 322. Sensor 430 can generate output signal 440 in-phase with noise wave 322 to provide a phase reference signal to phase detector 432. Phase detector 432 receives phase reference signal 340 from sensor 430 and anti-noise signal 324 output from noise generator 312. Phase detector 432 outputs phase difference signal 442, which can be, for example a voltage (which can alternate cyclically between a minimum and maximum voltage level) that corresponds to a difference in phase between input signals 324 and 440.

Phase alignment element 438 receives phase difference signal 442 and outputs a phase alignment signal, 448, to noise generator 312. Noise generator 312 can use phase alignment signal 448 to adjust the phase of anti-noise signal 324 to become in-phase with noise wave 322, based on the phase difference detected by phase detector 432. For example, noise generator 312 can include a circuit (not shown) that adjusts, or modifies, a voltage input to a VCO associated with generating anti-noise signal 324.

Phase alignment element 438 further outputs shift enable signal 444 to phase shifter 314. Phase alignment element 438 can output shift enable signal 444, for example, to control whether or how phase shifter 314 outputs anti-noise signal 326. For example, shift enable signal 444 can limit when, and/or with what amplitude, phase shifter 314 outputs anti-noise signal 326. For example, shift enable signal 444 can enable phase shifter 314 to output anti-noise signal 326 only when phase difference signal 442 indicates no difference in the phases of anti-noise signal 324 and phase reference signal 440. Shift enable signal 444 indicate to phase shifter 314 to output anti-noise signal 326 with a particular amplitude that can, in turn, corresponds to a phase difference between anti-noise signal 324 and phase reference signal 440 (e.g., to output anti-noise signal 326 with an amplitude corresponding to an amplitude of noise wave 322 at a particular phase difference with anti-noise signal 324).

FIG. 4 further illustrates an example implementation of a phase alignment element, which is depicted to only illustrate the disclosure, and is not intended to limit embodiments. Example phase alignment element 438 includes phase control logic 434 and loop filter 436. Phase control 434 can include logic to, for example, generate shift enable signal 444 based on phase difference signal 442.

Phase control 434 can include logic, or circuitry, to output phase difference signal 434 (e.g., when phase difference signal 442 indicates a phase difference) as output signal 446 to loop filter 436. A loop filter can operate to remove ("filter") particular frequencies from the output signal(s) of a phase detector, such as removing frequencies other than a BPF frequency of a fan. Correspondingly, loop filter 436 can receive output signal 446 (corresponding to phase difference signal 442 and filter out frequencies other than one or more particular frequencies (e.g., frequencies other than one or frequencies corresponding to higher amplitude frequencies of noise wave 322, such as frequencies other than a BPF). Loop filter 436 can then output the filtered phase difference signal as phase alignment signal 448 to noise generator 312.

Phase alignment signal 448 can represent (e.g., by a voltage level or signal frequency, or a combination thereof) a phase alignment value that, when received by noise generator 312, causes noise generator 312 to adjust the phase of anti-noise signal 324. For example, noise generator 312 can use phase alignment signal 348 to modify the input (or, control) voltage to a VCO that generates (or, is part of a circuit to generate) anti-noise signal 324.

Phase alignment element 438 of FIG. 4 illustrates one example embodiment of a phase alignment element, but is not intended to limit embodiments to the components and configuration of phase alignment 438. For example, in alternative embodiments, a phase alignment element may not include a loop filter, and may, instead generate phase alignment signal 448 from a phase control or other element included in the phase alignment element. Alternative embodiments can omit shift enable signal 444, for example, such that a phase shifter is always enabled to actively shift an input anti-noise signal, or a phase alignment element can output to a phase shifter a signal that indicates to the phase shifter to shift the input anti-noise signal by other than 180 degrees (e.g., an amount corresponding to the phase difference detected by a phase detector).

In alternative embodiments, a phase shifter can include phase alignment components within it and receive a phase difference signal to shift the input anti-noise signal to become 180 degrees out of phase with a noise wave. It would be apparent to one of ordinary skill in the art that embodiments can include elements illustrated in FIG. 4, or alternative phase alignment and phase shifting elements, and/or in configurations other that illustrated in FIG. 4, to produce an anti-noise signal approximately 180 degrees out of phase with a noise wave.

As previously described, conventional noise-cancelling systems, (e.g., conventional ANC systems or circuits) can require complex circuits (and/or processors) to analyze a broad range of noise frequencies, and noise power associated with each frequency, to determine which frequencies to cancel. Such complex processing can involve long processing times, and may not even be practical in some embodiments. In contrast, the foregoing examples of FIG. 3 and FIG. 4, illustrate that noise-cancelling circuits utilizing a control-status signal, having a predicted or known relationship to a noise frequency, can produce an anti-noise signal, and a corresponding noise-cancelling wave, more simply and quickly than conventional noise-cancelling systems.

Figure 5:
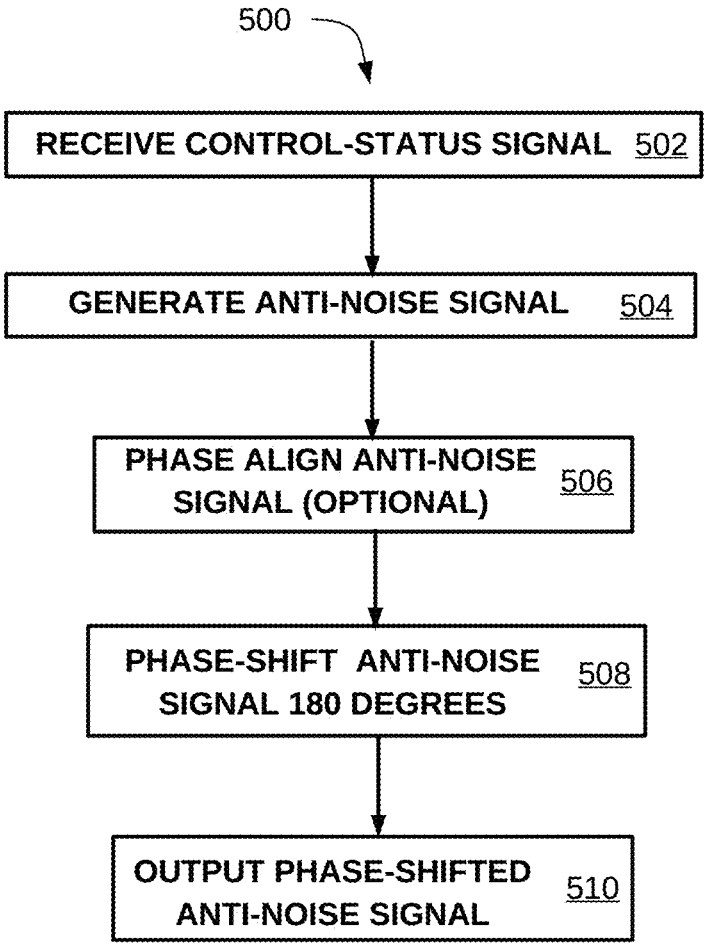
FIG. 5 is a flowchart illustrating an example method to generate an anti-noise signal, according to aspects of the disclosure.

FIG. 5 illustrates example method 500 to generate an anti-noise signal corresponding to noise in a system. For purposes of illustrating the method, but not limiting to embodiments, the method is described as embodied by an anti-noise circuit. At 502, the anti-noise circuit receives a control-status signal. The control-status signal can be, for example a fan speed control or, alternatively, a fan speed (e.g., RPM) status, signal such as previously described in reference to FIGS. 3 and 4.

At 504 the anti-noise circuit generates an anti-noise signal having a frequency of the noise in the system. The frequency can be associated with a particular power level (e.g., sound volume) of a noise relative to the power level of other frequency components of the noise (or, frequency components of multiple sources of noise in a system). The anti-noise circuit can, optionally, at 504 phase-align the anti-noise signal with the phase of the noise. The anti-noise circuit can use, for example, phase-lock methods or circuits, such as previously described in reference to FIG. 4.

At 508 the anti-noise circuit shifts the phase of the anti-noise signal. Shifting the phase of the anti-noise signal can produce an anti-noise signal more out-of-phase with the noise wave, and the anti-noise circuit can shift the phase by an amount up to 180 degrees.

At 520 the anti-noise circuit outputs the phase-shifted anti-noise signal. The output anti-noise signal can be received, for example, by a noise-cancelling device, or circuit, which can generate a noise-cancelling wave having the noise frequency and out-of-phase with the noise wave, such that the noise-cancelling wave can destructively combine with the noise wave to reduce the amplitude of the noise wave.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. An anti-noise apparatus for reducing acoustic noise in a system, the anti-noise apparatus comprising:

an anti-noise generator; and a phase shifter, wherein the anti-noise generator includes a voltage-controlled oscillator (VCO) configured to receive a control signal associated with a noise source, wherein the noise source emits an acoustic noise wave having a noise frequency, and wherein the noise frequency corresponds to voltage of the control signal;

wherein the anti-noise signal generator is further configured to generate, using the VCO, a first signal having the noise frequency, and wherein the anti-noise signal generator is configured to generate the first signal to have the noise frequency based on the noise frequency corresponding to the voltage of the control signal, wherein the VCO is configured to transform a particular voltage range of the control signal to a particular frequency range based on a known relationship between noise frequency and voltage of the control signal;

wherein the phase shifter is configured to receive the first signal and to generate a second signal having the noise frequency shifted in phase relative to the first signal; and wherein the phase shifter is further configured to output the second signal to enable generating, using the second signal, a noise-cancelling acoustic wave out of phase with the acoustic noise wave.

2. The anti-noise apparatus of claim 1 further comprising:

a phase detector;

a phase alignment element; and a sensor, wherein the sensor is configured to detect the acoustic noise wave and to output a phase reference signal having the noise frequency in-phase with the acoustic noise wave;

wherein the phase detector is configured to receive the phase reference signal and the first signal and to output a phase difference signal corresponding to a phase difference between the phase reference signal and the first signal;

wherein the phase alignment element is configured to receive the phase difference signal and to output, in response to the phase difference signal, a phase alignment signal; and wherein the anti-noise signal generator is further configured to receive, from the phase alignment element, the phase alignment signal and to generate and output, based at least in part on the phase alignment signal, the first signal in-phase with the acoustic noise wave.

3. The anti-noise apparatus of claim 1, wherein the system comprises one of a computer, a component of a computer, a computing system, and a component of a computing system.

4. The anti-noise apparatus of claim 1, wherein the anti-noise signal generator is further configured to receive a phase alignment signal and, based at least in part on the phase alignment signal, generate the first signal in-phase with the acoustic noise wave.

5. The anti-noise apparatus of claim 1, wherein the acoustic noise wave comprises noise associated with a fan.

6. The anti-noise apparatus of claim 5, wherein the noise frequency is a blade pass frequency of the fan.

7. The anti-noise apparatus of claim 5, wherein the control signal comprises a fan speed control.

8. A method for reducing acoustic noise in a system, the method comprising:

receiving a control signal associated with a noise source, wherein the noise source emits an acoustic noise wave having a noise frequency, and wherein the noise frequency corresponds to voltage of the control signal;

generating, using a voltage-controlled oscillator, a first signal having the noise frequency, wherein generating the first signal to have the noise frequency is based on the noise frequency corresponding to the voltage of the control signal, wherein the VCO is configured to transform a particular voltage range of the control signal to a particular frequency range based on a known relationship between noise frequency and voltage of the control signal;

generating, based on the first signal, a second signal having the noise frequency shifted relative to the first signal; and outputting the second signal to enable generating, using the second signal, a noise-cancelling acoustic wave out of phase with the acoustic noise wave.

9. The method of claim 8 further comprising:

detecting the acoustic noise wave and outputting, based on a phase of the acoustic noise wave, a phase reference signal having the noise frequency in-phase with the acoustic noise wave;

generating, using the phase reference signal and the first signal, a phase difference signal corresponding to a phase difference between the phase reference signal and the first signal;

generating, based at least in part on the phase difference signal, a phase alignment signal; and aligning, using the phase alignment signal, a phase of the first signal to be in-phase with a phase of the acoustic noise wave.

10. The method of claim 8, wherein the system comprises one of a computer, a component of a computer, a computing system, and a component of a computing system.

11. The method of claim 8, wherein the acoustic noise wave comprises noise associated with a fan.

12. The method of claim 11, wherein the noise frequency is a blade pass frequency of the fan.

13. The method of claim 11, wherein the control signal comprises a fan speed control.

14. The method of claim 11, wherein the fan is included in one of a computer, a component of a computer, a computing system, and a component of a computing system.

15. A method for reducing acoustic noise in a system, the method comprising:

receiving, by a voltage-controlled oscillator (VCO), a fan speed control signal associated with a fan, wherein the fan emits an acoustic noise wave having a blade passing frequency (BPF), and wherein the BPF corresponds to voltage of the fan speed control signal;

generating, by the VCO and by translating the voltage of the fan speed control signal, a first signal having a frequency corresponding to the BPF, wherein the VCO is configured to transform a particular voltage range of the fan speed control signal to a particular frequency range based on a known relationship between noise frequency and voltage of the fan speed control signal;

generating, based on the first signal, a second signal having the frequency corresponding to the BPF and phase shifted relative to the first signal; and outputting the second signal to enable generating, using the second signal, a noise-cancelling acoustic wave out of phase with the acoustic noise wave.

* * * * *